US005163238A

United States Patent [19]

Demarchi et al.

[11] Patent Number: 5,163,238

[45] Date of Patent: Nov. 17, 1992

[54] DOWNHILL SKI BOOT

[75] Inventors: Jean-Louis Demarchi, Saint-Jorioz; Jean-Marie Begey, Bonne, both of France

[73] Assignee: Salomon S.A., Annecy Cedex, France

[21] Appl. No.: 606,830

[22] Filed: Oct. 31, 1990

[30] Foreign Application Priority Data

Dec. 22, 1989 [FR] France ..... 89 17063

[51] Int. Cl.[5] ..... A43B 5/04

[52] U.S. Cl. ..... 36/119; 36/120; 36/121

[58] Field of Search ..... 36/117-121

[56] References Cited

U.S. PATENT DOCUMENTS

| | | | |
|---|---|---|---|
| 4,078,322 | 3/1978 | Dalebout | 36/121 |
| 4,085,528 | 4/1978 | Delery | 36/121 |
| 4,265,034 | 5/1981 | Salomon | 36/121 |
| 4,615,127 | 10/1986 | Delery | 36/117 |
| 4,644,671 | 2/1987 | Walkhoff | 36/120 X |
| 4,653,204 | 3/1987 | Morell et al. | 36/50 X |
| 4,665,635 | 5/1987 | Benoit et al. | 36/117 X |
| 4,685,226 | 8/1987 | Olivieri et al. | 36/120 |
| 4,945,660 | 8/1990 | Perrissoud | 36/117 X |
| 5,031,341 | 7/1991 | Paris et al. | 36/121 |
| 5,048,204 | 9/1991 | Tacchetto et al. | 36/50 |
| 5,065,530 | 11/1991 | Pozzobon et al. | 36/50 |

FOREIGN PATENT DOCUMENTS

| | | | |
|---|---|---|---|
| 0166961 | 1/1986 | European Pat. Off. | 36/117 |
| 0213520 | 3/1987 | European Pat. Off. | 36/117 |
| 0286586 | 10/1988 | European Pat. Off. | 36/117 |
| 2907163 | 8/1980 | Fed. Rep. of Germany . | |
| 3600438 | 7/1987 | Fed. Rep. of Germany | 36/117 |
| 2428413 | 1/1980 | France . | |
| 2585930 | 2/1987 | France . | |
| 9005466 | 5/1990 | World Int. Prop. O. | 36/117 |

*Primary Examiner*—Paul T. Sewell
*Assistant Examiner*—Ted Kavanaugh
*Attorney, Agent, or Firm*—Sandler, Greenblum & Bernstein

[57] ABSTRACT

A ski boot, preferably of the rear-entry type, including an upper portion selectively movable between an open position and a closed position. A control element, such as a cable, is included which can be associated with an arrangement for maintaining the foot or lower leg relatively fixed within the boot, or an arrangement for modifying the flexion of the boot. An arrangement is provided for tensioning the control element, in response to movement of an upper portion of the boot toward a closed position, which is mechanically independent of an arrangement for maintaining the tension in the control element.

17 Claims, 4 Drawing Sheets

DOWNHILL SKI BOOT

BACKGROUND OF THE INVENTION

1. Field of the Invention

The present invention relates generally to a boot for downhill skiing.

In a generally known manner, such downhill boots have a shell base and an upper.

The present invention relates more particularly to a rear entry ski boot, i.e., a boot having a rear portion referred to as a rear spoiler which is journaled on the shell base around a transverse axis. The front portion of the upper can be formed out of a single piece with the shell base or be a separate piece referred to as a cuff which is journaled on the shell base around a transverse axis.

The cuff and the rear spoiler are, depending upon the model, generally journaled around the same transverse axis or around two different axes, while for certain boot models, the rear spoiler is journaled on a transverse axis of the cuff.

The present invention relates to rear entry ski boots which comprise a rear spoiler journaled on the shell base around a transverse axis, regardless of the more specific arrangements which have been just described.

The present invention relates in a more specific manner to those boots which comprise an adjustment apparatus activated by a control element which must be tensioned during closure of the boot before skiing.

An adjustment apparatus of the aforementioned type can, for example, be adapted to assure the maintenance of the foot or of the lower leg of the skier or be adapted to limit the flexion of the upper of the boot.

It has previously been proposed to link the control element of such an apparatus to the rear spoiler of the boot such that it be tensioned by the movement of the rear spoiler with respect to the shell base during closure of the boot. These systems have the disadvantage of a relatively complex construction and are generally raised in relief with respect to the general profile or shape of the boot, which should be avoided.

SUMMARY OF THE INVENTION

The present invention has as an object to propose a novel boot of simple manufacture which comprises an adjustment system which is totally incorporated into the contour of the boot.

To this end, the ski boot of the rear entry type according to the invention, is formed by a shell base on which is journaled a rear portion or rear spoiler around a transverse axis, and which comprises an adjustment apparatus activated by a control element adapted to be tensioned during closure of the boot. The boot includes a means for tensioning the control element, a means for releasing the tension and for freeing the control element, and a means for maintaining the control element under tension, mechanically independent of the means of tensioning and releasing the tension and the means for freeing the control element.

In a further aspect of the invention, the tensioning means and the means for releasing the tension and the means for freeing the control element are carried by the rear spoiler, while the means for maintaining under tension is carried by the shell base.

Furthermore, according to the invention, the shell base has a seat in which the control element is positioned to be maintained under tension while the rear spoiler has means to receive or to extract the control element in the seat of the shell base.

According to another characteristic of the invention, the means which the rear spoiler have are formed by a lifting arm and a disengagement hook.

When the boot is opened, the control element is carried by the lifting arm of the rear spoiler. In the course of the rotational movement of the rear spoiler from the rear towards the front when the skier closes his boot, the control element is moved by the lifting arm to be tensioned.

During closure, the control element leaves the lifting arm and passes into the seat of the shell base. It is then maintained in tension by its positioning in this seat.

By means of such an arrangement, the control element is affixed to the shell base, and maintains during skiing a fixed tension whatever the movements of the upper of the boot.

When the skier opens his boot, the disengagement hook of the rear spoiler moves the control element out of the seat in the course of rotation from front to rear of the rear spoiler.

BRIEF DESCRIPTION OF THE DRAWINGS

The present invention would be better understood with reference to the annexed drawings, given by way of nonlimiting example only, in which.

DETAILED DESCRIPTION OF THE INVENTION

Figure 1:
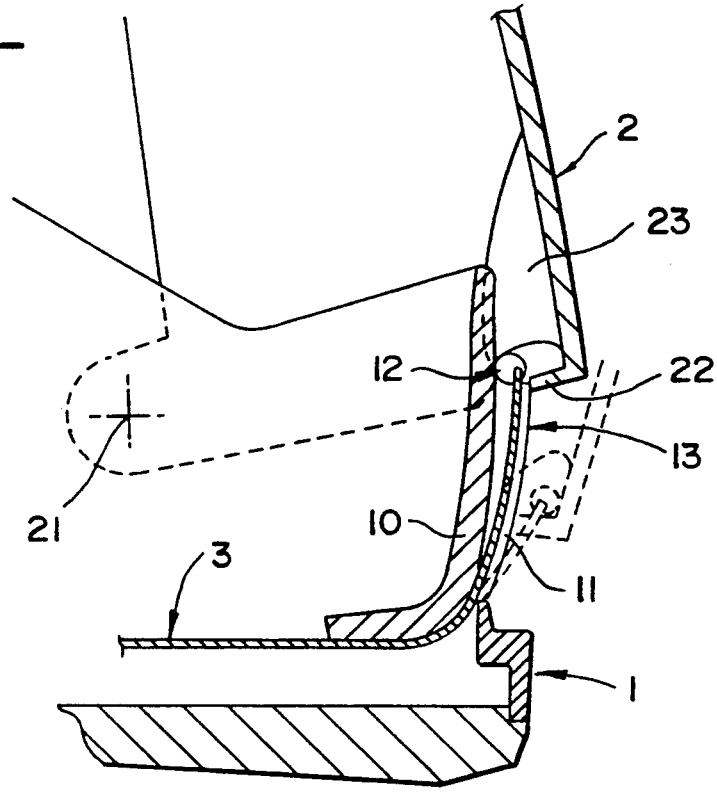
FIG. 1 is a partial view in cross-section of a ski boot according to the invention.

As may been seen in FIG. 1, the rear portion of the ski boot formed of a shell base 1 and having a rear spoiler 2 journaled with respect to the shell base around a transverse axis 21 usually formed by a rivet on each side of the ankle.

Shell base 1 has to the rear of wall 10 forming the rear of the sole at least one rib 11 whose upper surface forms the seat 12 for the control element 3 of an adjustment apparatus. The rib 11 can be in one portion situated in the median plane of the boot, or can be in two or more portions distributed around the periphery of the heel. The rib 11 extends circumferentially over a lesser distance than the heel such that the control element formed by cable 3 can extend vertically on each side thereof.

Surface 13 which is turned towards the rear of rib 11 serves, as will be seen below, as a guidance ramp for cable 3 in the course of opening and closure movements of the rear spoiler 2.

Rear spoiler 2 has at its lower end a lifting arm 22 formed by a wall which is generally perpendicular to the wall of the rear spoiler in the direction of the shell base. At a small distance above the lifting arm 22 there is positioned a disengagement hook 23 directed towards the lifting arm.

FIG. 1 shows in solid lines the various elements in the position in which they occupy when the boot is closed while the dash lines illustrate the rear spoiler in its open position.

Figure 2A:
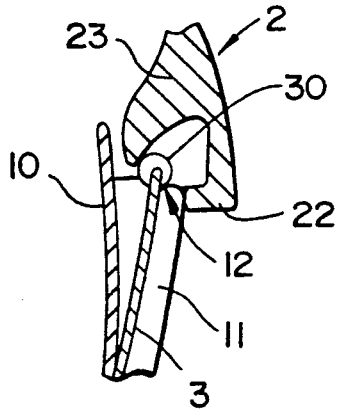
FIGS. 2*a*, 2*b*, 2*c*, 2*d* illustrate the operation of this boot in the course of a movement of the rear spoiler.

FIGS. 2a-2d illustrate the operation of the boot. As seen in FIG. 2a, the boot is closed such that wherein cable 3 is not carried by the rear spoiler but is positioned in the seat 12 of rib 11. So as to allow for better activation of cable 3, the cable carries an enlargement, such as a generally cylindrical member 30 which will be described with reference to FIGS. 3a and 3b.

Figure 2B:
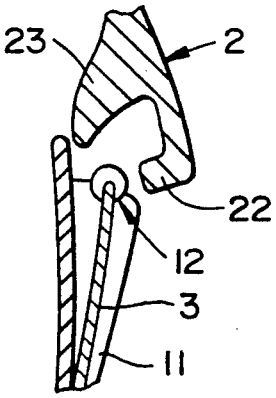

When during skiing the skier flexes the lower leg, the rear spoiler 2 assumes the position such as that shown in FIG. 2b. It will be seen that cable 3 positioned in seat 12 is not at all influenced by these frontward movements of rear spoiler 2. The tensioning of the cable as it was adjusted at the beginning by the skier is not changed. Thus, a predeterminate tension can be maintained during movement of the upper portion of the boot, i.e., the rear spoiler e.g., relative to the shell base 1 of the boot during skiing.

Figure 2C:
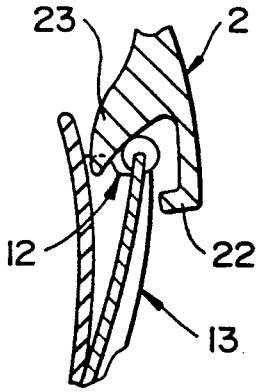

When the skier unhooks his boot and opens it, the rear spoiler 2 is displaced to the position shown in FIG. 2c for which the disengagement hook 23 enters into contact with enlargement 30 of cable 3. Continuation of the opening movement of the rear spoiler causes the disengagement hook 23 to move cable out of seat 12, freeing the cable 3 from the tension therein during engagement with the seat 12. Cable 3 being under tension it falls against the lifting arm 23 as may be seen in FIG. 2d, as soon as it escapes from seat 12. In the course of the movement of rear spoiler 2, cable 3 is in the space defined by lifting arm 22 and guidance ramp 13 of rib 11.

It will be understood that during closure of the boot, cable 3 is pulled upwardly by lifting arm 22 in the course of the movement of rear spoiler 2 until the position shown in FIG. 2a for which the lifting arm 22 is at the level of seat 12. The tension to which cable 3 is subjected makes it pass into seat 12.

Figure 2D:
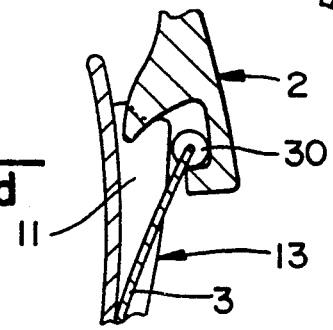

According to a more detailed embodiment, the inner wall of the lifting arm 22 is preferably provided with an elastic element 24 which operates in compression when the cylindrical enlargement 30' of the control means is captured between the guide ramp 13 of the rib and the rear spoiler 2, in the position shown in FIG. 2d. This constructive disposition facilitates the positioning of enlargement 30' in seat 12.

Figure 3A:
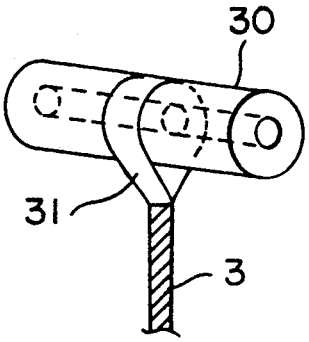
FIGS. 3*a* and 3*b* respectively illustrate two forms given to the control element in its portion adapted to collaborate with the rear spoiler and the seat of the shell base.
Figure 3B:
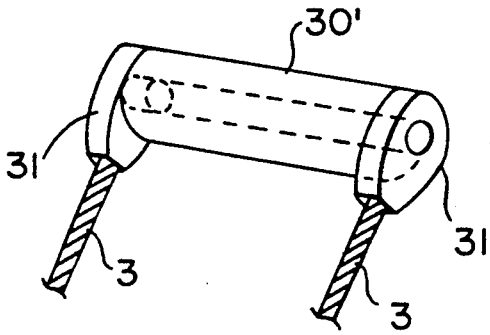
Figure 8:
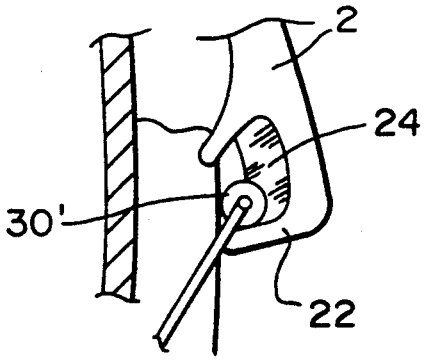
FIGS. 4, 5, 6, 7, and 8 are alternative embodiments of the invention.

FIGS. 3a and 3b illustrate two examples of embodiment of the enlargement 30 provided on cable 3 so as to facilitate the hooking thereof by the disengagement hook 23.

When one must pull only on one end of cable 3, an end piece 31 thereof will be positioned between two portions adapted to form the cylindrical enlargement 30. In the case where one must pull on the two ends of cable 3, they are provided with end pieces 31 which will be affixed to the two ends of the cylindrical enlargement 30'.

Figure 4:
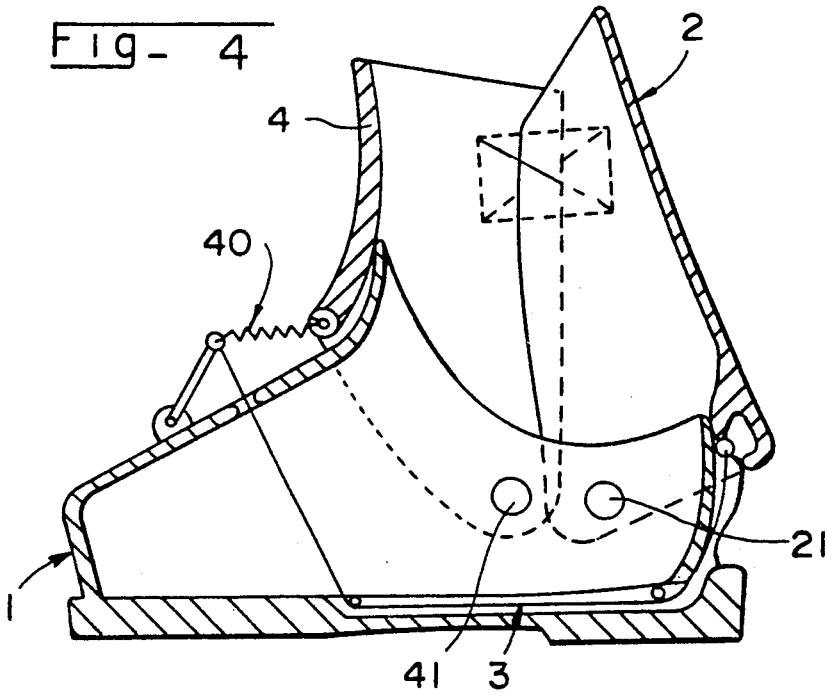

FIG. 4 illustrates a boot according to the invention in which the adjustment apparatus comprising cable 3 is a flexion control apparatus 40 of the upper in the case where the upper is formed of a cuff 4 and a rear spoiler 2 journaled around axes 41 and 21 of shell base 1.

Figure 5:
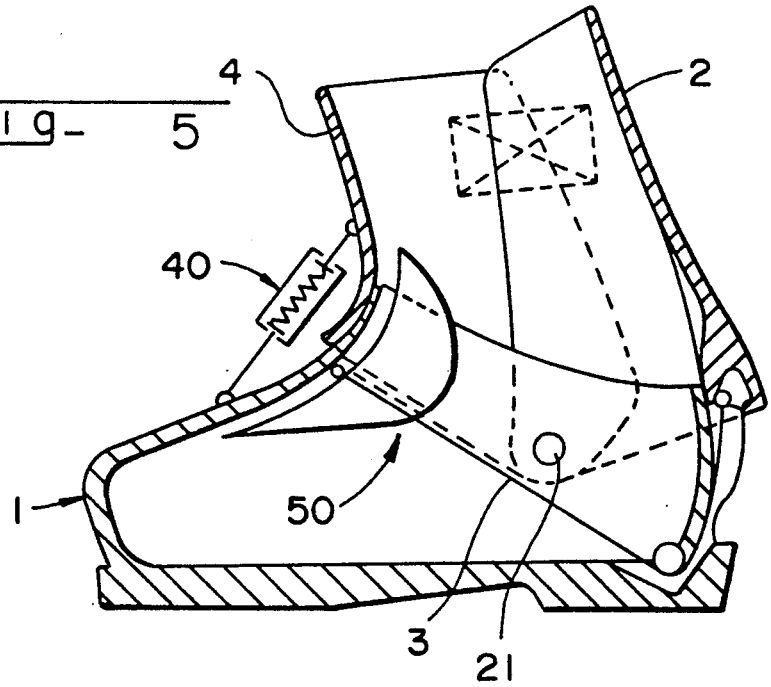

In FIG. 5 apparatus 50 is a foot retention system close to the ankle of the skier. The boot has a cuff 4 and a rear spoiler 2 journaled on the shell base 1 around a single axis 21. Flexion control apparatus 40 is controlled independently of rear spoiler 2.

Figure 6:
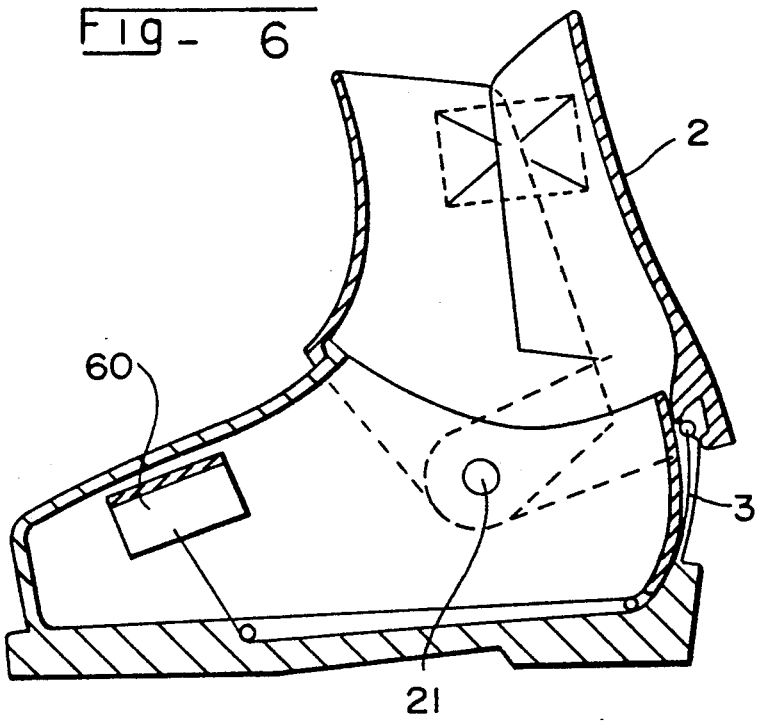
Figure 7:
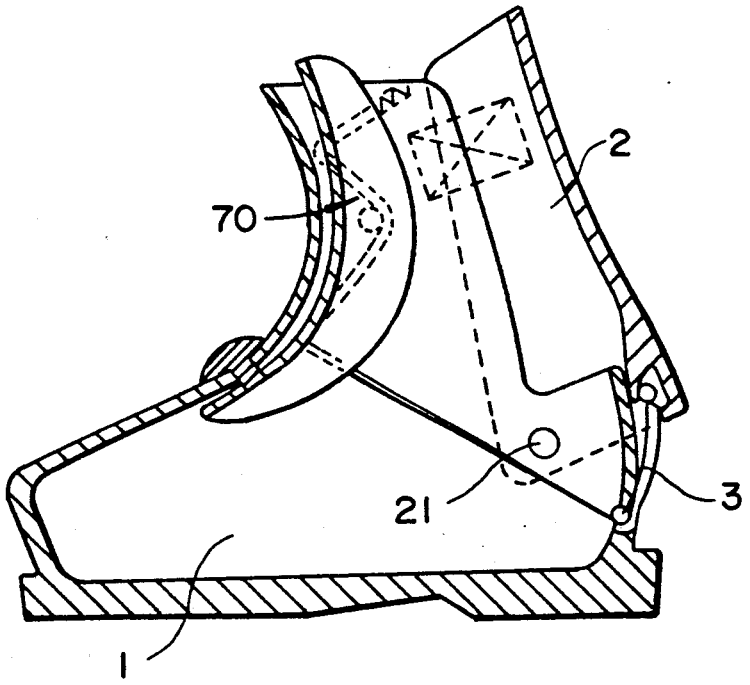

In FIG. 6, apparatus 60 is a system assuring the maintenance of the front of the foot while in FIG. 7 the front portion of the upper is "monobloc", made out of a single piece, with the shell base 1 and the apparatus 70 assures the retention of the lower leg.

Although not always represented, it is understood that a regulating apparatus of the length of cable 3 is provided in a known manner on said cable.

We claim:

1. A ski boot comprising:

a shell base;

an upper portion selectively movable between an open position and a closed position relative to the shell base;

a control element adapted to be selectively greater tensioned and lesser tensioned;

a first element, the first element being carried by one (1of the upper portion of the skit boot and (2) the shell base of the ski boot, for increasing the tension of the control element in response to movement of the upper portion of the boot toward the closed position; and a second element, the second element being carried by the other of (1) the upper portion of the ski boot and (2) the shell base of the ski boot, for maintaining tension in the control element.

2. The ski boot of claim 1, further comprising a third element, the third element carried by the one of (1) the upper portion of the ski boot and (2) the shell base of the ski boot that carries the first element, for decreasing the tension of the control element in response to movement of the upper portion toward the open position.

3. The ski boot of claim 2, the first element comprising a lifting arm for tensioning the control element, the second element comprising a seat for securing the control element in a tensioned position, and the third element comprising a disengagement hook for removing the control element from the tensioned position.

4. A ski boot comprising:

an upper portion selectively movable between an open position and a closed position;

a control element adapted to be selectively greater tensioned and lesser tensioned;

means for increasing tension in said control element in response to movement of said upper portion toward said closed position;

means for maintaining tension in said control element mechanically independent of said means for increasing said tension of said control element; and a shell base, said means for increasing said tension of said control element being carried by said upper portion of said ski boot and said means for maintaining tension in said control element being carried by said shell base.

5. The ski boot of claim 4, said ski boot comprising a rear-entry ski boot, and said upper portion of said ski boot comprising a rear spoiler.

6. A ski boot comprising:

an upper portion selectively movable between an open position and a closed position;

a control element adapted to be selectively greater tensioned and lesser tensioned;

means for increasing tension in said control element in response to movement of said upper portion toward said closed position;

means for maintaining tension in said control element mechanically independent of said means for increasing said tension of said control element;

means for decreasing tension in said control element in response to movement of said upper portion toward said open position, said means for maintaining tension of said control element being mechanically independent of said means for decreasing said tension of said control element, said means for decreasing said tension of said control element further comprising means for freeing said control element from said tension; and a shell base, wherein said means for increasing said tension of said control element, said means for decreasing said tension of said control element, and said means for freeing said control element from said tension is carried by said upper portion of said ski boot and wherein said means for maintaining tension in said control element is carried by said shell base.

7. The ski boot of claim 6, said ski boot comprising a rear-entry ski boot, and said upper portion of said ski boot comprising a rear spoiler.

8. The ski boot of claim 7, said rear spoiler being journalled on said shell base about a generally transverse axis, said rear spoiler being movable toward said closed position and movable toward said open position about said transverse axis, said ski boot further comprising an adjustment apparatus activatable by said increasing said tension of said control element in response to movement of said rear spoiler toward said closed position, wherein said means for maintaining tension in said control element comprises a seat carried by said shell base for securing said control element in a first position, wherein said means for increasing said tension of said control element comprises a first portion of said rear spoiler for movement of said control element to said position, and wherein said means for decreasing said tension of said control element comprises a second portion of said rear spoiler for movement of said control element from said position.

9. The ski boot of claim 8, said first position of said rear spoiler comprises a lifting arm and said second portion of said rear spoiler comprises a disengagement hook.

10. The ski boot of claim 8, said shell base comprising a rear wall and a generally rearwardly extending rib carried by said rear wall, wherein said seat is carried by an upper portion of said rib.

11. The ski boot of claim 10, said rear spoiler having a rear wall, said first portion of said rear spoiler comprising a lifting arm extending generally perpendicularly of said rear wall for moving said control element to be secured by said seat, and said second portion of said rear spoiler comprising a disengagement hook for moving said control element for disengagement from being secured by said seat

12. The ski boot of claim 11, said lifting arm having an interior and an elastic element positioned at said interior of said lifting arm for cooperation with positioning of said control element relative to said seat.

13. The ski boot of claim 9, said disengagement hook being spaced upwardly from said lifting arm.

14. The ski boot of claim 8, further comprising an enlargement connected to said control element, said enlargement being adapted to be seated in said seat.

15. The ski boot of claim 10, said seat comprising a concave surface and said enlargement comprising a convex surface, said concave surface of said seat being adapted to receive said convex surface of said enlargement.

16. The ski boot of claim 15, said enlargement comprising a generally cylindrical member.

17. The ski boot of claim 11, said rib comprises a guidance ramp for sliding engagement with relation to said control element, a portion of said control element being captured between said lifting arm and said guidance ramp during movement of said control element in a direction to be secured by said seat.

* * * * *